US006938792B2

(12) United States Patent
Gerger

(10) Patent No.: US 6,938,792 B2
(45) Date of Patent: Sep. 6, 2005

(54) DRIP-PROOF INSET

(75) Inventor: Patrik Gerger, Upplands Vasby (SE)

(73) Assignee: Tollco AB, Knivsta (SE)

( * ) Notice: Subject to any disclaimer, the term of this patent is extended or adjusted under 35 U.S.C. 154(b) by 142 days.

(21) Appl. No.: 10/246,469

(22) Filed: Sep. 19, 2002

(65) Prior Publication Data

US 2003/0057215 A1 Mar. 27, 2003

(30) Foreign Application Priority Data

Sep. 24, 2001 (SE) ..... 0103172

(51) Int. Cl.[7] ..... B65D 1/34
(52) U.S. Cl. ..... 220/571; 229/92
(58) Field of Search ..... 229/930, 92.1, 229/92.7, 117.02, 117.05, 87.5, 87.18, 906, 92, 117.01; 220/571, 7; 294/1.3

(56) References Cited

U.S. PATENT DOCUMENTS

| | | | | |
|---|---|---|---|---|
| 3,345,670 A | * | 10/1967 | Charie | 15/257.1 |
| 3,534,424 A | * | 10/1970 | Levinson | 15/105 |
| 4,421,267 A | * | 12/1983 | Wischoff | 229/150 |
| 5,110,038 A | * | 5/1992 | Pantisano et al. | 229/103 |
| 5,197,659 A | * | 3/1993 | Vassiliou | 229/117.01 |
| 5,209,392 A | * | 5/1993 | Anatro | 229/117.01 |
| 5,579,812 A | * | 12/1996 | Bigwood | 141/109 |
| 6,202,689 B1 | | 3/2001 | Williams | |
| 6,640,991 B1 | * | 11/2003 | Amanat et al. | 220/574 |

FOREIGN PATENT DOCUMENTS

| | | |
|---|---|---|
| BE | 1011510 A3 | 10/1999 |
| DE | 86 12 310.6 U1 | 6/1986 |
| GB | 2 269 528 | 2/1994 |
| GB | 2 269 528 A | 2/1994 |
| JP | A 10-339453 | 12/1998 |
| SE | 9303257-1 | 6/1997 |

OTHER PUBLICATIONS

JP 10–330453, Dec. 1998, JPO machine translation, pp. 1–7, translated Oct. 31, 2004.*

* cited by examiner

*Primary Examiner*—Joseph C. Merek
(74) *Attorney, Agent, or Firm*—Young & Thompson

(57) ABSTRACT

A drip-proof inset includes a bottom and a U-shaped border surrounding the same, which border is composed of two side pieces and one back piece. Initially, the inset is in the shape of a plane sheet (A) that includes a number of scorings. Namely, two first scorings (8), along which two side pieces (3') can be turned up at an angle to a bottom-forming part (1') of the sheet, a second scoring (9), along which a back piece (4') can be turned up at an angle to the bottom sheet part (1'), as well as at least one additional, third scoring (11) that extends halfway between two opposite edges (7) of the sheet in order to, before turning-up of said back and side pieces, enable folding of the sheet in the middle during formation of two folded-up sheet halves having a halved surface area.

7 Claims, 3 Drawing Sheets

DRIP-PROOF INSET

TECHNICAL FIELD OF THE INVENTION

Figure 1:
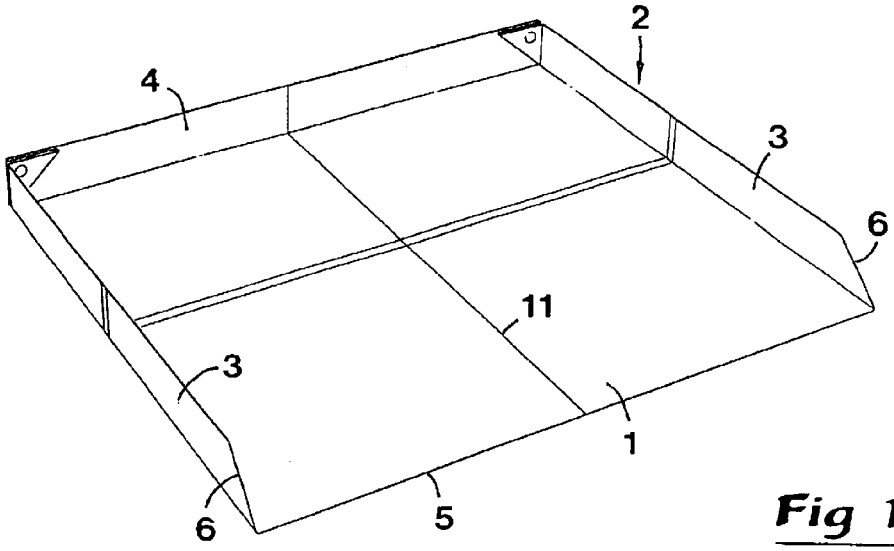

This invention relates to a drip-proof inset of the type that comprises a bottom and a U-shaped border surrounding the same, which border includes two side pieces and one back piece, and which initially is in the shape of a plane sheet that includes a number of scorings, viz. two first scorings along which two side pieces can be turned up at an angle to a bottom-forming part of the sheet, and a second scoring along which a back piece can be turned up at an angle to the bottom-forming sheet part.

PRIOR ART

Drip-proof insets are per se previously known by the Swedish patents SE 9303257-1 and SE 9403370-1 as well as the Swedish design registrations 51093 and 56357. The drip-proof inset described in SE 9403370-1 is intended to be placed on the bottom of a kitchen sink bottom cupboard and has the purpose of intercepting possible dripping seepage water from the proper kitchen sink and leading the water forth towards the front of the kitchen sink bottom cupboard with the purpose of making also small water leakages visible. The drip-proof inset being the subject of SE 9303257-1 is in the form of an underlay intended to be applied under such white goods machines as refrigerators and freezers. Also in this case, the drip-proof inset has the purpose of intercepting dripping water and leading the same forth to a visible area in front of the refrigerator or freezer. The drip-proof insets shown in the design registrations 51093 and 56357 likewise consist of underlays for household appliances.

Common to all of the previously known drip-proof insets is that the same are manufactured from plastic that is formed, e.g. vacuum-formed, in one single continuous piece, the back and side pieces of the inset protruding approximately perpendicularly from the inset with the back piece permanently united with the side pieces in uniting corner portions. After the manufacture, the inset has an invariable surface area that is fairly large. Thus, the bottom of the inset may have a surface area of approximately 50×60 cm in order for the inset to fit in under, for instance, a refrigerator, a freezer or a stove (other measurements do also occur). This comparatively large surface area gives rise to difficulties in connection with the distribution of the insets to different purchasers. Delivery of large quantities of the insets to large-scale purchasers, such as real estate companies, large housing co-operatives or the like, may be carried out in a fairly simple way inasmuch as the insets may then be loaded and transported in large quantities on loading pallets or the like. Difficulties arise, however, when occasional or a few insets are to be delivered to small purchasers, such as individual house owners or apartment households. In this case, the insets have to be packed individually in packagings being at least as large as the proper inset and be sent to the purchaser by mail or the like. This means that the freight charge becomes disproportionately high in comparison with the cost of the proper inset. Another and at times bigger problem is the fact that the surface area of the inset is of such a dimension that the inset, in the packaged state thereof, cannot be put into letter boxes or delivered via the letter drop. The consequence of this may easily be that individual, potential users of the insets refrains from acquiring the product although the same in an effective way counteracts damages caused by moisture that are insidious and difficult to trace in the floors and floor cupboards respectively.

OBJECTS AND FEATURES OF THE INVENTION

The present invention aims at overcoming the above-mentioned problems by providing an improved drip-proof inset. Therefore, a primary object of the invention is to provide a drip-proof inset, the surface area of which may be drastically reduced after manufacturing of the inset in order to enable a simple and inexpensive distribution thereof to all types of purchasers. Thus, the insets should be possible to package and dispatch one by one to individual purchasers without the freight charges becoming unreasonable. Furthermore, the inset should in its packaged state be possible to deliver into a letter box or through a letter drop.

According to the invention, at least the primary object is attained by the features defined in the characterizing clause of claim 1. Preferred embodiments of the invention are furthermore defined in the dependent claims.

FURTHER ELUCIDATION OF THE PRIOR ART

A drip-proof inset of the art is previously known by GB 2 269 528 A. This inset has, however, no third scoring half-way between two opposite edges of the originally claim sheet. Accordingly, it is not possible to halve the surface of the inset as taught by the present invention.

BRIEF DESCRIPTION OF THE APPENDED DRAWINGS

Figure 2:
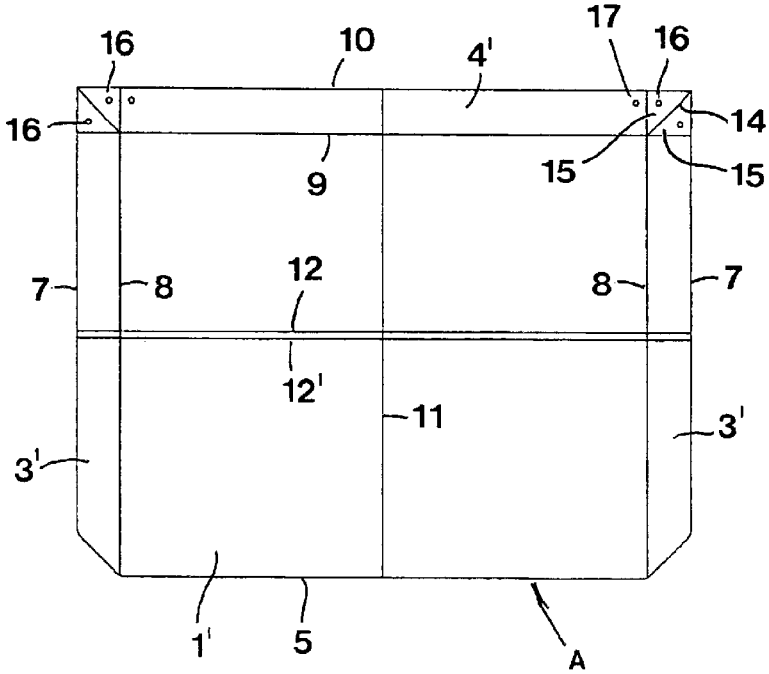
Figure 3:
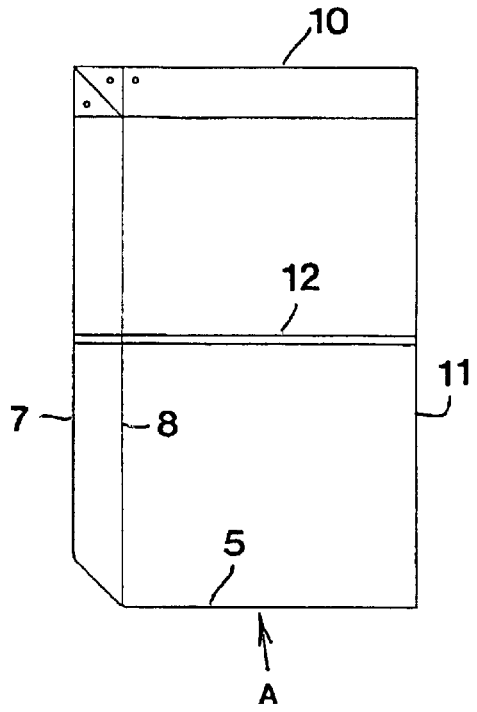
Figure 4:
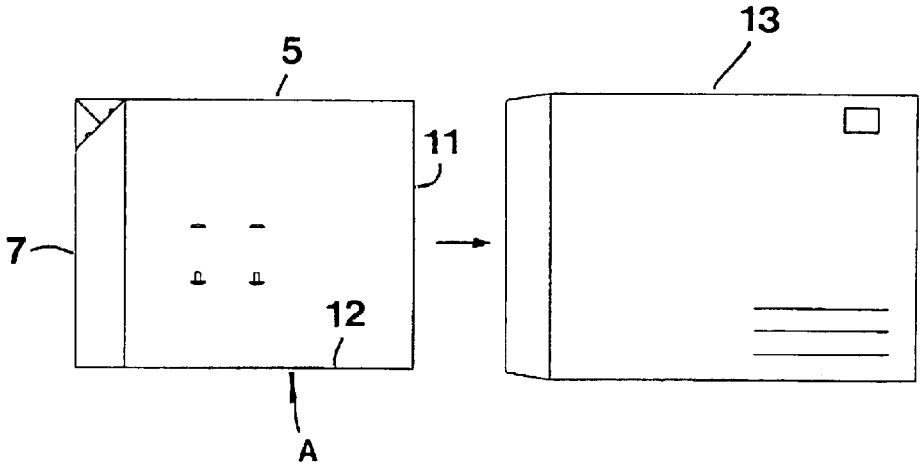
Figure 6:
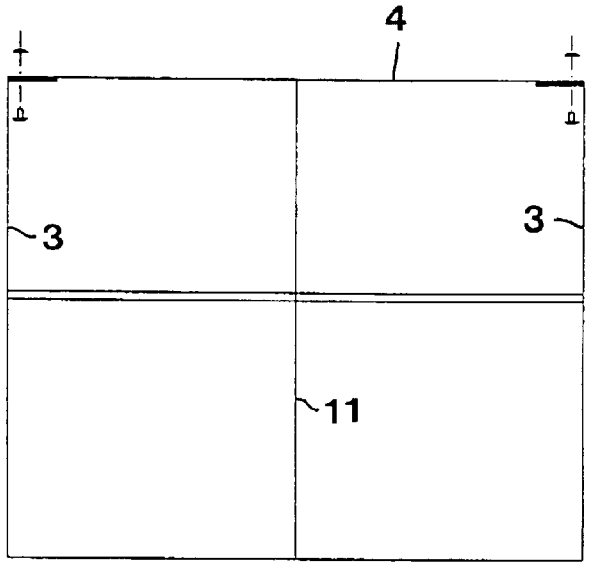
Figure 5:
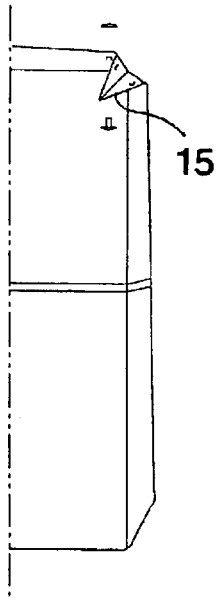
Figure 8:
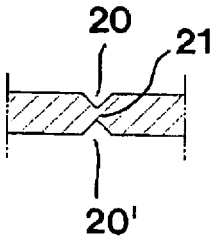
Figure 7:
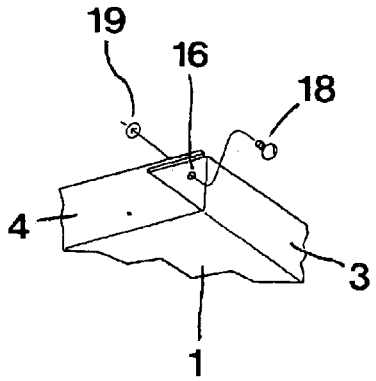

In the drawings:

FIG. 1 is a perspective view of a drip-proof inset in a usage position,

FIG. 2 is a planar view from above of a work piece in the form of a sheet for the forming of an inset according to FIG. 1, FIG. 3 is a planar view showing the sheet according to FIG. 2 in a single-folded state, FIG. 4 is an exploded view showing the same sheet in a double-folded state as well as an envelope for receiving the double-folded sheet, FIG. 5 is a partial planar view showing how a back piece and a side piece included in the inset can be connected to each other in a corner, FIG. 6 is a planar view from above of the inset in the same state as in FIG. 1, FIG. 7 is a partial perspective view showing an angular joint between the back piece and a side piece, and FIG. 8 is an enlarged partial section through the sheet in the area of a scoring.

DETAILED DESCRIPTION OF A PREFERRED EMBODIMENT OF THE INVENTION

In FIG. 1, a drip-proof inset is shown in a state ready for use, for instance, under a refrigerator, a freezer, a dishwasher, a stove or in a bottom cupboard of a kitchen sink. The inset includes a bottom 1 that is surrounded by an upright, substantially U-shaped border generally designated 2, which is composed of two side pieces 3 and a back piece 4 uniting said side pieces. The border 2 opens in the direction of a front edge 5. In a previously known way, dripping liquid that is intercepted on the bottom 1 inside the border may run out on the floor in the area in front of the inset and a device standing on the same, e.g. a dishwasher, in order to be ocularly detected. The bottom is slightly rectangular and may in practice have the size of 498×596 mm. The height of the border 2 may amount to 52 mm. As is seen in FIG. 1, the front portion of each side piece 3 may have an obliquely inclined edge 6.

In previously known drip-proof insets of the type in question, the U-border 2 protruding from the bottom 1 has been formed with the back piece 4 integrated with the side pieces 3, e.g. through vacuum forming of plastic.

Characteristic of the present invention is that the inset initially is in the form of a plane sheet A of the type shown in FIG. 2. Advantageously, said sheet A is also manufactured from plastic and has a thickness that does not exceed 1 mm. In practice, the sheet may be manufactured from polypropene and have a thickness of 0.8 mm. In the sheet, a plurality of different scorings are formed, which permit folding of the sheet into the shape shown in FIG. 1. More precisely, two first scorings 8 are formed near two opposite side edges 7 of the sheet, which scorings are straight and interparallel and also parallel to the edges 7, if these are straight and interparallel. A second scoring 9 is formed near the rear edge 10 of the sheet. The scoring 9 is perpendicular to the scorings 8, and parallel to the straight rear edge 10. Between the individual scoring 8 and a side edge 7, a sheet field 3' is defined, which forms a side piece after turning-up along the scoring 8. In an analogous way, a sheet field 4' is defined between the scoring 9 and the rear edge 10, which forms the back piece 4 after turning-up. In the area halfway between the side edges 7, a third scoring 11 extends, which like the scorings 8 extends all the way from the front edge 5 of the sheet to the rear edge 10. Around this intermediate scoring 11, the plane sheet can be folded a first time during the formation of two folded sheet-halves having a halved surface area, as is shown in FIG. 3. Suppose that the width between the two opposite side edges 7 initially amounts to 700 mm (52+596+52 mm). After folding around the scoring 11, this measure has been reduced to 350 mm.

Furthermore, perpendicularly to the scoring 11, at least a fourth scoring 12 extends. Said fourth scoring 12 enables a second folding, more precisely of the pair of sheet halves that in accordance with FIG. 3 have already been folded a first time. In this way, also the surface area of the two folded sheet halves is halved, as is shown in FIG. 4. Suppose that the distance between the edges 5 and 10 amounts to 550 mm (498+52). After double folding of the sheet into the state illustrated in FIG. 4, this measurement has been reduced to approx. 275 mm.

In order to facilitate the second folding of the sheet, a secondary fourth scoring 12' is formed in the immediate vicinity of the primary fourth scoring 12. Said two scorings 12, 12' may be located at a limited distance from each other, e.g. approx. 5–10 mm.

The sheet is of a slightly rectangular shape in the original state thereof according to FIG. 2, as well as in the double folded state thereof according to FIG. 4. In the double folded state according to FIG. 4, the sheet may be inserted into a packaging 13, e.g. an envelope, having a limited size. More precisely, the double folded sheet may be packaged in a packaging, the surface area of which is merely approximately ¼ of the surface area of the original, unfolded sheet.

At each individual corner, the scorings 8 and 9 intersect at a right angle, more precisely in a point from which a fifth scoring 14 extends in a bisector-like way at a 45° angle to the scorings 8, 9. Along with the scorings 8, 9, each fifth scoring 14 defines two triangular sheet fields 15 in which holes 16 are formed. Furthermore, near each corner, an additional hole 17 is formed in the sheet field 4', which is to form the back piece 4.

As shown in FIG. 5, the two triangular fields 15 can be folded inwards as well as rearwards towards the back piece 4, after which said back piece 4 is permanently connected with each side piece 3 via a fastening element which can be inserted into said holes. Although the fastening element may be formed in many ways, the type that is illustrated in FIG. 7 and that includes a head-provided peg 18 having a waved envelope surface as well as a washer 19, which may be pressed firmly on the peg, is preferred.

The individual scorings that are included in the sheet may be achieved in any arbitrary way by means of known technique. For instance, the scoring may consist of a single score 20 on one side of the sheet. However, scorings of the type illustrated in FIG. 8 are preferred. Here, a pair of scores 20, 20' are hobbed or otherwise formed on opposite sides of the sheet, a narrowed, central waist 21 being left in the sheet. By the existence of double scores, it is guaranteed that the user can fold the sheet in any direction, i.e. without any need to think about any determined order when folding the different sheet fields.

In this connection, it should be pointed out that the individual score advantageously has a conformal cross-section along the entire length thereof.

An important advantage of the drip-proof inset according to the invention is that the same may be manufactured in a simple way and folded to a compact state which enables simple and cost efficient distribution in occasional copies to different purchasers. Before installation, the inset may be given a desired, final form by the simple step of turning up the border-forming back and side pieces and connecting the same by means of simple fastening elements.

What is claimed is:

1. A foldable underlay for collecting liquids underneath domestic equipment, comprising:

a rectangular, planar sheet of waterproof material, having a front edge, a rear edge, and two opposite side edges;

a pair of first scoring lines running parallel with said side edges from the front edge to the rear edge;

a second scoring line running parallel to said rear edge from one side edge to the other, the second scoring line intersecting said pair of first scoring lines at right angles;

a bottom surface defined by said first and second scoring lines and said front edge, said bottom surface connecting to a back piece at said second scoring line, and to a pair of side pieces at said first scoring lines, respectively;

a third scoring line running parallel to said first scoring lines from said front edge to said rear edge, midways between said first scoring lines;

a fourth scoring line running parallel to said second scoring line from one of said side edges to the other, intersecting said third scoring line at right angles midways between said front and rear edges, and a pair of fifth scoring lines, each running from an intersection between said first and second scoring lines to a corner of the planar sheet; and wherein said fourth scoring line is a double scoring line.

2. The foldable underlay of claim 1, wherein said fifth scoring lines extend at 45° angle relative to said first and second scoring lines.

3. The foldable underlay of claim 1, wherein said first, second, third, fourth and fifth scoring lines are formed from opposite sides of the planar sheet, leaving a central waist in each scoring line.

4. The foldable underlay of claim 1, having a maximum thickness of 1.0 mm.

5. The foldable underlay of claim 1, further comprising a plurality of fastening elements, a respective one of said fastening elements extending through holes on both sides of each of said fifth lines and said back piece.

6. A foldable underlay for collecting liquids underneath domestic equipment, comprising a rectangular planar sheet of waterproof material, having a front edge, a rear edge, and two opposite side edges;

a pair of first scoring lines running parallel with said side edges from the front edge to the rear edge;

a second scoring line running parallel to said rear edge from one side edge to the other, the second scoring line intersecting said pair of first scoring lines at right angles;

a bottom surface defined by said first and second scoring lines and said front edge, said bottom surface connecting to a back piece at said second scoring line, and to a pair of side pieces at said first scoring lines, respectively;

a third scoring line running parallel to said first scoring lines from said front edge to said rear edge, midways between said first scoring lines;

first and second fourth scoring lines, running at a limited distance from each other and parallel to said second scoring line from one of said side edges to the other, intersecting said third scoring line at right angles midways between said front and rear edges, wherein the planar sheet is foldable once along the third scoring line for halving the area of the planar sheet, and foldable twice along the fourth scoring lines for quartering the area of the planar sheet.

7. The foldable underlay of claim 6, further comprising a pair of fifth scoring lines each running from an intersection between said first and second scoring lines to a corner of the planar sheet at 45° angle relative to said first and second scoring lines, wherein the waterproof underlay is provided by unfolding the folded sheet firstly along the fourth scoring lines, secondly along the third scoring line, and thirdly by turning the back piece and side pieces upright about the second and first scoring lines, respectively, and connecting the back and side pieces through folding about the first, second and fifth scoring lines at the corners of the waterproof underlay.

* * * * *